US008381693B2

(12) United States Patent
Rust et al.

(10) Patent No.: US 8,381,693 B2
(45) Date of Patent: Feb. 26, 2013

(54) HYDRAULICALLY OPERATED VALVE ACTUATION AND INTERNAL COMBUSTION ENGINE WITH SUCH A VALVE ACTUATION

(75) Inventors: Bernhard Rust, Glattfelden (CH); Patrik Soltic, Uhwiesen (CH); Christian Bach, Wangen (CH)

(73) Assignee: EMPA Eidgenossische Materialprufungs-und Forschungsanstalt, Dubendorf (CH)

( * ) Notice: Subject to any disclaimer, the term of this patent is extended or adjusted under 35 U.S.C. 154(b) by 243 days.

(21) Appl. No.: 12/734,745

(22) PCT Filed: Nov. 19, 2008

(86) PCT No.: PCT/EP2008/009772

§ 371 (c)(1),
(2), (4) Date: May 20, 2010

(87) PCT Pub. No.: WO2009/065566

PCT Pub. Date: May 28, 2009

(65) Prior Publication Data

US 2010/0307433 A1 Dec. 9, 2010

(30) Foreign Application Priority Data

Nov. 23, 2007 (EP) ..... 07022717

(51) Int. Cl.
*F01L 9/02* (2006.01)
*F01L 1/34* (2006.01)
*F01L 1/30* (2006.01)

(52) U.S. Cl. ..... 123/90.12; 123/90.13; 123/90.14; 123/90.15; 123/90.24

(58) Field of Classification Search ..... 123/90.12, 123/90.13, 90.14
See application file for complete search history.

(56) References Cited

U.S. PATENT DOCUMENTS

| | | | | |
|---|---|---|---|---|
| 3,209,737 | A | 10/1965 | Omotehara at al. | |
| 3,727,595 | A | 4/1973 | Links | |
| 3,844,528 | A | 10/1974 | Massie | |
| 3,865,088 | A | 2/1975 | Links | |
| 5,058,857 | A | 10/1991 | Hudson | |
| 5,225,641 | A | 7/1993 | Weld et al. | |
| 5,456,222 | A * | 10/1995 | Schechter | 123/90.12 |
| 6,170,524 | B1 | 1/2001 | Gray, Jr. | |

(Continued)

FOREIGN PATENT DOCUMENTS

| | | |
|---|---|---|
| CH | 417 219 A | 6/1963 |
| DE | 1 944 177 | 3/1971 |

(Continued)

*Primary Examiner* — Thomas Denion
*Assistant Examiner* — Steven D Shipe
(74) *Attorney, Agent, or Firm* — George Pappas

(57) ABSTRACT

According to the invention, recuperation may be optimized for a hydraulically-operated gas exchange valve by provision of two fluid-filled pressure chambers and a movable regulating piston with two active faces each defining one of the pressure chambers. The pressure chambers are each connected to two hydraulic valves of which the first hydraulic valves may be pressurized from a first pressure reservoir and the second hydraulic valves may be connected to a base pressure reservoir. The first hydraulic valves may furthermore be connected to a second pressure reservoir. A control or regulation device switches the valves, from a rest position in a first accelerating phase and a braking phase. The second pressure reservoir is provided as pressure buffer for providing the pressure in the first pressure reservoir and/or for providing pressure for the fuel pump and/or for the fuel supply to an internal combustion engine and/or for providing pressure for a further gas exchange valve in the same or another combustion cylinder of the internal combustion engine.

28 Claims, 2 Drawing Sheets

U.S. PATENT DOCUMENTS

| | | | | |
|---|---|---|---|---|
| 6,223,846 | B1 | 5/2001 | Schechter | |
| 6,745,731 | B2 * | 6/2004 | Tanaka et al. | 123/90.12 |
| 6,971,348 | B1 * | 12/2005 | Sun | 123/90.15 |
| 7,040,266 | B1 | 5/2006 | Sun et al. | |
| 7,134,408 | B2 * | 11/2006 | Diehl et al. | 123/90.12 |
| 7,832,374 | B2 * | 11/2010 | Verner et al. | 123/446 |
| 2004/0035378 | A1 | 2/2004 | Gaessler et al. | |
| 2004/0035388 | A1 * | 2/2004 | Diehl et al. | 123/322 |
| 2004/0107699 | A1 * | 6/2004 | Fales et al. | 60/414 |
| 2006/0283411 | A1 | 12/2006 | Lou | |
| 2007/0272180 | A1 * | 11/2007 | Lou | 123/90.12 |

FOREIGN PATENT DOCUMENTS

| | | | |
|---|---|---|---|
| DE | 199 31 129 | A1 | 7/1999 |
| DE | 101 43 959 | A1 | 9/2001 |
| DE | 10 2005 047 180 | A1 | 4/2007 |
| EP | 1 186 783 | A2 | 3/2002 |
| EP | 1 536 107 | A1 | 1/2005 |
| WO | WO 02/46582 | A2 | 6/2002 |
| WO | WO 02/066796 | A1 | 8/2002 |
| WO | WO 03/008770 | A1 | 1/2003 |
| WO | WO 2006/121637 | A1 | 11/2006 |

* cited by examiner

HYDRAULICALLY OPERATED VALVE ACTUATION AND INTERNAL COMBUSTION ENGINE WITH SUCH A VALVE ACTUATION

The application claims priority of PCT application PCT/EP2008/009772 having a priority date of Nov. 23, 2007, the disclosure of which is incorporated herein by reference.

TECHNICAL FIELD

The invention relates to a fluid-operated valve drive, in particular for a gas exchange valve in a combustion cylinder of an internal combustion engine and to an internal combustion engine having such a valve drive.

BACKGROUND OF THE INVENTION

Fluid-operated valve drives, in particular for gas exchange valves in a combustion chamber of an internal combustion engine, which within the context of this invention encompass both hydraulically and also pneumatically operated valve drives, have long been known. Firstly, said valve drives were used to replace a camshaft-controlled opening of an engine valve, while the closing of the valve continued to be provided by means of a spring mechanism. Such systems are known for example from the German laid-open specification 1,944,177. However, bidirectionally controlled fluid operated valve drives for valve control arrangements have also already long been known in principle, for example from CH 417,219. Here, use is usually made of the principle that an actuating piston has two surfaces which are acted on with pressure and of which one is larger than the other. In CH 417,219, however, it is also proposed that the fluid supply—in this case the oil supply—be controlled by means of a conventional camshaft. Said principle is also inherent in the proposal according to DE 101 439 59 A1, in which however the valve control arrangement operates without a camshaft. In DE 101 439 59 A1, the surface area of at least one of the two active surfaces of the actuating piston should vary along the movement path of said actuating piston. It is also proposed therein that one of two fluid pressure chambers is in each case filled with a fluid and emptied. Said proposal has proven not to be especially advantageous since the valve control arrangement cannot be set up very precisely with a manageable amount of expenditure.

A significant improvement of said concept is known originally from U.S. Pat. No. 5,225,641 A, and proposed in improved form in U.S. Pat. No. 6,223,846 B1, referred to hereinafter as Schechter. It is proposed here that two oppositely arranged active surfaces be acted on in each case with a fluid which is extracted from a common reservoir and controlled by means of supply valves. The outflow valves are provided inter alia for pressure relief. Said system is however very complex and can only be used to a limited extent on account of the complex fluid supply control.

In relation to conventional mechanically driven valve drives, fluid-operated valve drives basically have the disadvantage or the problem of higher energy consumption, since the power of the internal combustion engine is then lost. The known fluid-operated valve drive devices—in particular also the devices known from U.S. Pat. No. 5,058,857, from U.S. Pat. No. 3,844,528, DE 199,31129, U.S. Pat. No. 6,170,524, WO-A-02/46582 and WO-A-02/066,796—have in common the fact that the problem of increased energy consumption is not solved or is only rudimentarily solved. For example, in WO-A-02/066,796, although it is provided there that a buffer store should absorb pressure fluctuations, the hydraulic fluid from the outlet of the piston for valve control is however conducted into a reservoir, from which said hydraulic fluid must be pumped back up to the working pressure of the hydraulic system by means of a high-pressure pump, which wastes energy. A typical system with increased energy consumption in which the fluid is simply returned into the reservoir is known from WO 2006/121637 A1.

In Schechter, it has already been proposed that not only the acceleration of the fluid-operated valves but rather also the braking for a smooth set-down onto the valve seat be carried out by means of a fluid. It is also already indicated in said document that the energy which can be recovered as a result of the braking—by means of a low-pressure rail in said document—should be used. A first approach for recuperation has thereby already been disclosed. However, in Schechter, the high-pressure rail must still be fully charged with pressure, since the low-pressure rail is connected only to the reservoir. Said inferior type of recuperation likewise has room for improvement.

US 2004/107699 A1 describes a fluid-operated piston drive in which first approaches for recuperation have likewise already been proposed. The type of recuperation proposed therein is entirely suitable for use for example in a forklift truck etc. but, on account of its complexity, would appear to be entirely unsuitable for use for driving an actuating piston for an internal combustion engine, and would not appear to be a model for solving the above-described problem. The rudimentary recuperation as proposed in US 2004/107699 A1 has the particular disadvantage that the recovered pressure must be used as it accumulates.

SUMMARY OF THE INVENTION

It is an object of the invention to provide a simplified fluid-operated valve drive in which the above-described disadvantages of the prior art are eliminated. In particular, the energy consumption should not be increased by the valve control. Moreover, the most optimum possible form of recuperation should be used.

The object of the invention is achieved initially by means of a fluid-operated valve drive. Here, the measures of the invention firstly have the result that the energy which can be recovered by means of the braking of the engine valves is supplied to an intermediate pressure level. Said intermediate pressure level may be arranged between the valve acceleration pressure and the reservoir, which for example saves energy for charging the valve acceleration pressure and simultaneously serves to provide an optimally damped braking process. The recuperation of the second pressure reservoir P1 may however basically also be used for the pressure conditioning for the provision of pressure for the fuel pump, and/or for the fuel conditioning, such as for example vaporization etc. If, as a special embodiment of the invention, fuel is used as a fluid, and in particular when diesel fuel is used, said pressure conditioning may be carried out directly. If the fluid is simultaneously used as fuel, this may be not only a hydraulically usable fluid but rather also a pneumatically usable gas or similar medium, for example in gas-operated engines. Furthermore, the recuperation of an engine valve or of a plurality of engine valves with a higher pressure requirement—for example the outlet valves of an internal combustion engine—may also be used for the pressure conditioning of another engine valve or a plurality of other engine valves with a lower pressure requirement—for example the inlet valves of the internal combustion engine.

To be able to implement the invention, it is basically possible to switch directly from the acceleration phase into the braking phase. This also produces the fastest engine valve movement with minimum fluid pressure. In energy terms, however, it may be advantageous for a non-accelerated overrunning phase to be incorporated between said two phases, if permitted by the valve movement speed. The length of the overrunning phase provides a further control or regulating parameter.

It is basically possible for the second fluid valve means to be designed either as proportional valves, which can then be quantity-controlled, or else—or additionally—simple valves with only one open and one closed position and time control. It would however appear to be advantageous—at least for certain applications—to make said valves controllable for fine adjustment with regard to their degree of opening. For the first fluid valve means, however, a design as fluid valves only with selective open and closed positions to P1 and P2 would appear to be to be adequate and advantageous.

For fine adjustment, it would appear—in certain cases—to be advantageous if, during the transition phase from the first to the second phase and/or from the second to the third phase, both second fluid valve means can be connected for a certain period of time to the base pressure reservoir P0 while one of the first fluid valve means is open. It is thereby prevented—in particular in the case of a hydraulic design—that a phase occurs in which the pressure chambers are closed and the movement of an only slightly compressible fluid can lead to shocks or excess pressure. It is pointed out that corresponding problems are also possible in the case of a pneumatic design, which problems can be eliminated by means of this advantageous design. For fast control, an embodiment with solenoid valves is advantageous. Particularly advantageous is an embodiment of the invention in which a measuring sensor is provided for measuring the position of the engine valve, preferably by means of a measurement of the position of the actuating piston, by means of which measurement the opening and closing of the fluid valve means is controlled or regulated.

Further advantageous embodiments of the invention are described in the claims.

The advantages of the invention, in particular within the context of the proposed design, may be summarized as follows: with the proposed valve control, free control of the entire movement sequence for each individual valve is possible without further expenditure, for example the lift height from 0 to maximum, accelerations, braking processes and speeds. An extremely wide variety of states and demands are therefore met, such as starting without a starter, throttle-flap-free operation, optimization of the air inlet into the combustion chamber at all engine speeds, early closing of the outlet valve for NOx reduction, valve adjustment for boosting the engine braking action, cylinder shut-down at part load, unpressurized rest state with valves held closed mechanically, emergency running with partial shut-down of the engine, etc. High energy efficiency is also obtained with short and streamlined paths for the fluid, a low pressure, which can be adapted to the operating state, in the high-pressure system, low mass and therefore low energy requirement for accelerating and braking the moved masses, movable parts guided at the top and bottom without bending loading, slim valve shank and low friction resistances, small piston and hydraulic and pneumatic effective surfaces and low wear. Operational reliability is high on account of technical simplicity, without boosting of the initial acceleration (on account of a low moved mass). Also advantageous is the control on the basis of the effective movement of the engine valves with the possibilities of automatic correction of shifts of the cycle on account of thermal dilatation, changing viscosity of the fluid, gas bubbles, production tolerances and mechanical wear with attrition of the sealing between the piston and cylinder wall. With the system, low maintenance is to be expected on account of low mechanical loading of the components, of the closed system with few sealing surfaces, a simple exchange of the entire valve actuating arrangement, individual valves or components. The geometry is advantageous because no disruption of the paths for intake air and exhaust gases is to be expected, and there is little spatial requirement.

A further advantage of the invention is that the demands on the engine oil of engines with a mechanical valve drive are defined primarily by the camshaft drive of the valves, and necessitate the corresponding addition of additives to the engine oil. Said addition of additives is based partially on substances which are detrimental to the exhaust-gas aftertreatment (catalytic converter poisons such as phosphorous or zinc). Without measures to reduce the poisoning of the exhaust-gas aftertreatment, the high service lives which will be demanded in future in exhaust-gas legislature cannot be adhered to. To eliminate said oil-based damage to the exhaust-gas aftertreatment arrangement, complex measures (for example separate lubricating oil circuits for camshaft and valve drive on the one hand and crankshaft and pistons on the other hand) are under discussion. Hydraulically or pneumatically operated valve drives considerably reduce the demands on the engine oil in relation to mechanically operated valve drives, which ultimately also has a positive effect on the service life of the exhaust-gas aftertreatment arrangement.

In another embodiment, said aspect of the invention is characterized in that the movement sequence of the engine valve is monitored with regard to its movement travel by means of a sensor. At all times, the deviation of the effective location of the engine valve from its setpoint location according to specification is determined and measured by means of a control unit for said engine valve. The change in the cross section of the corresponding second fluid valve means is calculated such that the valve returns to the position according to specification. According to said aspect of the invention, the system is self-correcting by means of said function, and influences which can unfavorably vary the movement of the engine valve need not be taken into consideration.

According to a further aspect of the invention, the recuperation of the above-described valve drive, that is to say the conditioned pressure prevailing in the second reservoir, is used exclusively or additionally for the valve drive of a different valve drive of the internal combustion engine. Since the working pressures for the fluid pressure of the outlet valves of an internal combustion engine should conventionally be higher than the working pressures of the inlet valves—since the outlet valves must operate at most at least briefly counter to the combustion gas pressure—a design is then particularly advantageous in which, in the internal combustion engine, the valve drives of the outlet valves are designed according to the invention and the recuperation energy thereof is designed for the lower fluid pressures of the valve drives of the inlet valves. In this case, it is possible for a pressure arrangement according to the prior art to be provided for the valve drives of the inlet valves, in which only one common pressure reservoir—specifically the second pressure reservoir of the outlet valves—is provided in addition to the base reservoir. Said second pressure reservoir would then ideally not additionally need to be supplied with pressure.

The elements mentioned above and the elements claimed and described in the following exemplary embodiments, and which are to be used according to the invention, are not subject to any particular exceptions with regard to their size, shaping, material usage and their technical design, such that the selection criteria known from the respective application may be used without restriction.

BRIEF DESCRIPTION OF THE DRAWINGS

Further details, advantages and features of the subject matter of the present invention will emerge from the following description of the associated drawings, in which devices according to the invention are explained by way of example. In the drawings.

DETAILED DESCRIPTION OF THE PREFERRED EMBODIMENTS

Figure 1:
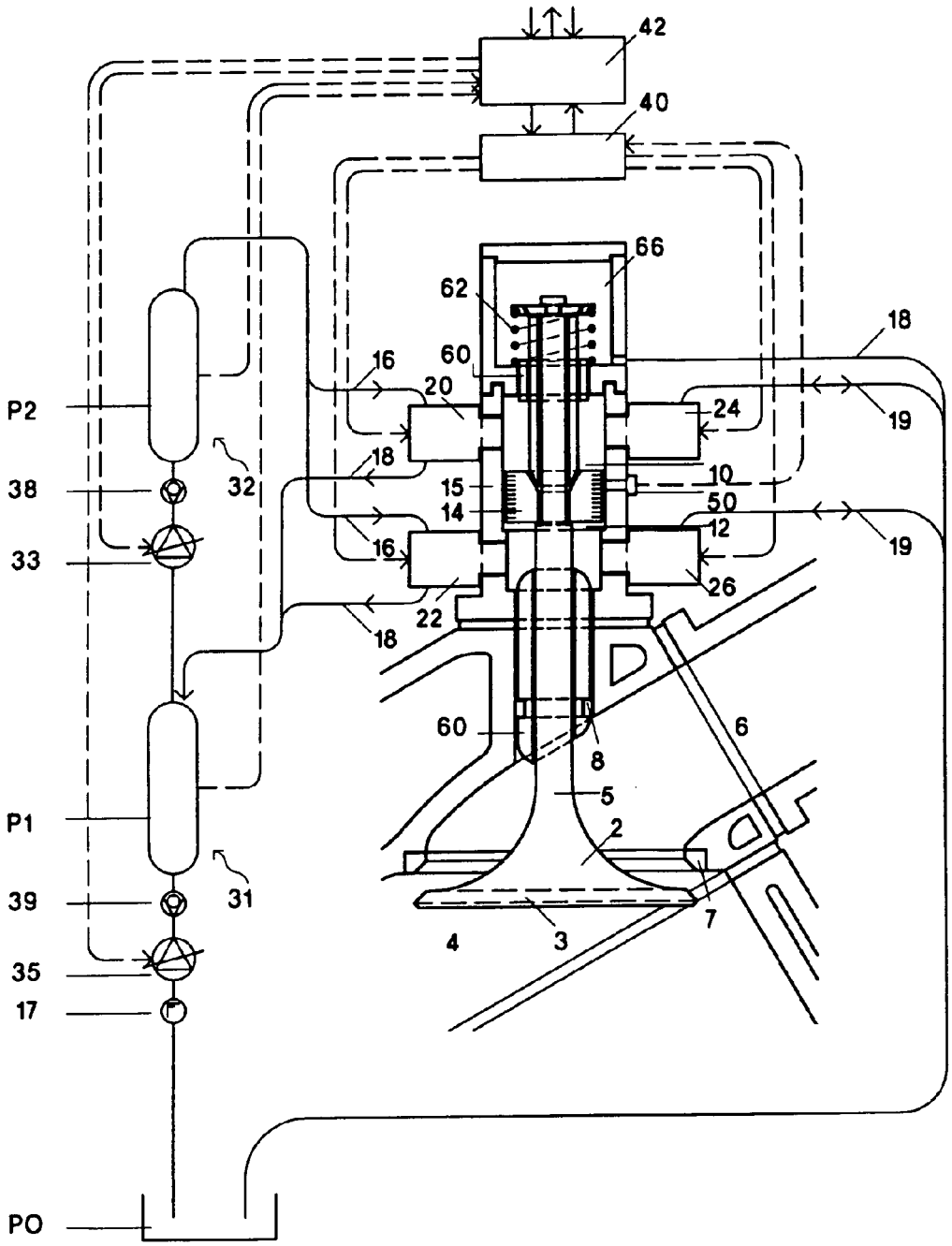
FIG. 1 shows an illustration of an engine valve with a valve control arrangement according to a first exemplary embodiment of the invention.

FIG. 1 illustrates a valve arrangement according to a first exemplary embodiment of the present invention, having an engine valve 2 and having a driving device (actuator) for said engine valve. The valve 2 comprises—in the usual way—a valve plate 3 which is adapted to a valve seat ring 7 in order to close off the engine bay. When the valve 2 is open, that is to say when the valve is lowered, the combustion chamber 4 of the engine is connected to the combustion gas duct 6. It is said connection that is to be controlled or regulated by means of the valve drive.

The engine valve 2 bears, on its valve shank 5, an actuating piston 14 which is fixedly connected thereto and which has an upper active surface, which is formed on the upper side of the actuating piston 14, and also a lower active surface, which is formed on the underside of the actuating piston 14. Together with the pressure chamber housing 15 in which the actuating piston 14 is arranged so as to be movable upward and downward, the actuating piston 14 forms an upper pressure chamber 10 and a lower pressure chamber 12. The two pressure chambers 10 and 12 have in each case one first fluid valve 20 and 22 and one second fluid valve 24 and 26 for a pressure fluid, in the exemplary embodiment described here a hydraulic oil or the fuel for the engine, preferably a diesel fuel. In the present exemplary embodiment, said fluid valves are designed as solenoid valves, with in each case only one open and one closed position being provided for the first fluid valves 20 and 22 in each case via the fluid inflow line 16 to the pressure reservoir P2 and via the fluid outflow line 18 to the pressure reservoir P1, while the second fluid valves 24 and 26 can be connected in each case via the fluid inflow and outflow line 19 to the base reservoir P0. The second fluid valves 24 and 26 can be controlled in analog or—alternatively—digital fashion into a multiplicity of positions. It is pointed out at this juncture that said analog or digital modulating design of the opening of the second fluid valves 24 and 26 is merely exemplary.

Other modulation methods such as intermittent opening, if necessary also with for example pulse width modulation assuming a suitable bandwidth of the opening, may likewise be used.

The two first fluid valves 20 and 22 can be selectively connected to a first pressure reservoir P2 for the pressurized fluid and to a second pressure reservoir P1. Here, it is provided that, to accelerate the engine valve 2 in each case one direction, one of the first fluid valves 20 and 22 is opened and therefore the first pressure reservoir P2 is connected to one of the two pressure chambers. Here, for acceleration for the purpose of opening the engine valve 2, the upper first fluid valve 20 is opened. So as not to generate a counter pressure, the lower second fluid valve 26, which is connected to the base reservoir P0, is simultaneously opened. Here, for acceleration for the purpose of closing the engine valve 2, the lower first fluid valve 22 is opened. So as not to generate a counter pressure, the upper second fluid valve 24, which is connected to the base reservoir P0, is now simultaneously opened.

As already mentioned, the first fluid valves 20 and 22 can also be connected to a second pressure reservoir P1. Here, it is provided that, to brake the engine valve 2 in each case one direction, one of the first fluid valves 20 and 22 is opened and therefore the second pressure reservoir P1 is connected to one of the two pressure chambers.

Here, for braking during the opening of the engine valve 2, the lower first fluid valve 22, connected to the second pressure reservoir P1, is opened. To continue to fill the upper pressure chamber 10 with fluid, the upper second fluid valve 24 which is connected to the base reservoir P0 is simultaneously opened. Here, the fluid flows, unpressurized, into the upper pressure chamber 10.

Here, for braking during the closing of the engine valve 2, the upper first fluid valve 20, connected to the second pressure reservoir P1, is opened. To continue to fill the lower pressure chamber 12 with fluid, the lower second fluid valve 26 which is connected to the base reservoir P0 is simultaneously opened. Here, the fluid flows, unpressurized, into the lower pressure chamber 12.

In the present exemplary embodiment, it is provided, and the control arrangement is also set up in such a way, that a non-accelerated movement can be carried out in each case between the acceleration and the braking processes. Here, the two first fluid valves 20 and 22 are closed and the two second fluid valves 24 and 26 are opened, such that the engine valve 2 performs a virtually uniform movement and in each case one pressure chamber 10 or 12 is emptied and the other pressure chamber 10 or 12 is filled to the same extent. It will be clear to a person skilled in the art that, by means of the length of said non-accelerated phase, the movement of the engine valve can be regulated using measurement data regarding the present position of the engine valve 2. This is provided in the exemplary embodiment.

It is also provided in the present exemplary embodiment that, for a short time, both second fluid valves 24 and 26 are open while the first fluid valve 20 or 22 are still open. This has the effect that no shocks occur as a result of the incompressible fluid.

The supply for the first fluid valves 20 and 22 is fed from said base reservoir P0—as described below.

Above, in each case individual fluid valves 20, 22, 24, 26 have been described for the fluid valve means according to the invention. In particular, the first fluid valve means 20 and 22 with the selective connections, described in the exemplary embodiment, to P1 and P2 may however also be designed in each case as separate fluid valves for P1 and P2—without restricting the generality of the invention. Provision may also be made for the second fluid valve means 24 and 26 to be divided into in each case one merely switchable fluid valve and additionally one fluid valve which can be controlled in terms of its flow rate, if the specific design of the hydraulic or pneumatic relationships and/or the regulating bandwidth necessitate this.

In the present exemplary embodiment, two-stage pressure generation is carried out from the base reservoir P0 firstly to the second pressure reservoir P1 and from there to the first pressure reservoir P2, in each case by means of a pressure stage 31 and 32 which comprises a regulable high-pressure pump 33 and 35 respectively and a non-return valve 38 and 39 respectively.

In said exemplary embodiment, therefore, the energy recovered by means of the braking of the engine valves 2 is used in its entirety for maintaining the pressure in the first pressure reservoir P2 in that—after a starting process—the first pump from P0 to P1 consumes very little energy and the high-pressure pump from P1 to P2 is correspondingly relieved of load. An optimal recuperation system is therefore proposed.

A central electronic control/regulating unit 42 determines, for each engine valve, the optimum movement sequence for each engine valve on account of the ambient and operating conditions and transmits said specification to the electronic valve control device 40, which outputs the commands for opening the fluid valves. Each engine valve 2 has a separate electronic valve control device 40. The position of the engine valve 2 is detected over the entire movement path and transmitted to the valve control device 40 by means of a measuring sensor 50, and said valve control device 40, in the event of deviations from the setpoint value, corrects the opening of the respective outlet solenoid valve 24 and 26 to P0. The lift of the engine valves 2 and the course of the movement over time may be determined freely. The central electronic control/regulating unit 42 determines the pressure in the high-pressure system, specifically in the pressure reservoirs P2 and P1.

In the fluid pressure system P2, the same pressure prevails for all the engine valves 2 which it supplies. The pressure may be adapted to different operating conditions by controlling the regulable high-pressure pump 33.

As parameters for the regulation by means of the central regulating device 42, use is made, for example, of the following: throttle pedal position, brake actuation, gear selection, program selection of automatic transmission, temperatures of engine oil or water, position of the vehicle (ascending or descending gradient), outside air temperature.

Each engine valve 2 has a valve control device 40 which, by means of control commands to the fluid valves 20 and 22 and also 24 and 26, controls the movement of the engine valve as precisely as possible according to the specifications of the central valve regulating device 42.

All the valve control devices 40 of an engine transmit the parameters of the valve movement back to the central regulating device 42, which can adapt the pressure in the high-pressure system—in particular in the first pressure reservoir P2. With said system of the comparison of the actual position of the engine valve 2 with the setpoint position, deviations from the specification are corrected. Such deviations may have different causes, for example for the fluid: temperature, viscosity and aging, and with regard to wear: play between the piston and cylinder chamber, production tolerances.

The valve shank 5 of the engine valve 2 protrudes, at the upper delimitation of the upper pressure chamber 10, through the cover of the cylinder. A spiral spring 62 acts, in a valve spring chamber 66, on a spring plate which is connected to the valve shank 5. In the event of faults in a limited number of engine valves, the relevant cylinder—or else plurality of cylinders—may be partially shut down and the pistons moved passively. An emergency running program with mechanical restoration of engine valves 2 into a rest state is therefore provided. In the rest state, the fluid in the high-pressure system can be discharged by means of a brief opening of all the fluid valves. The engine valves 2 are guided by means of said springs 62 into their upper position in order that servicing and repairs can be carried out in the unpressur±zed state. The valves do not come into contact with the pistons of the engine when said pistons are in the vicinity of top dead center. The cylinder head, when removed from the engine block, may be put down in the installed position without the risk of damage. The mounting and dismounting of the valve drive are thereby considerably simplified. Fluid which passes into the valve spring chamber 66 through the upper valve guide 60 at the transition from the upper pressure chamber 10 to said valve spring chamber 66 is conducted through an opening into the unpressurized base reservoir P0.

Figure 2:
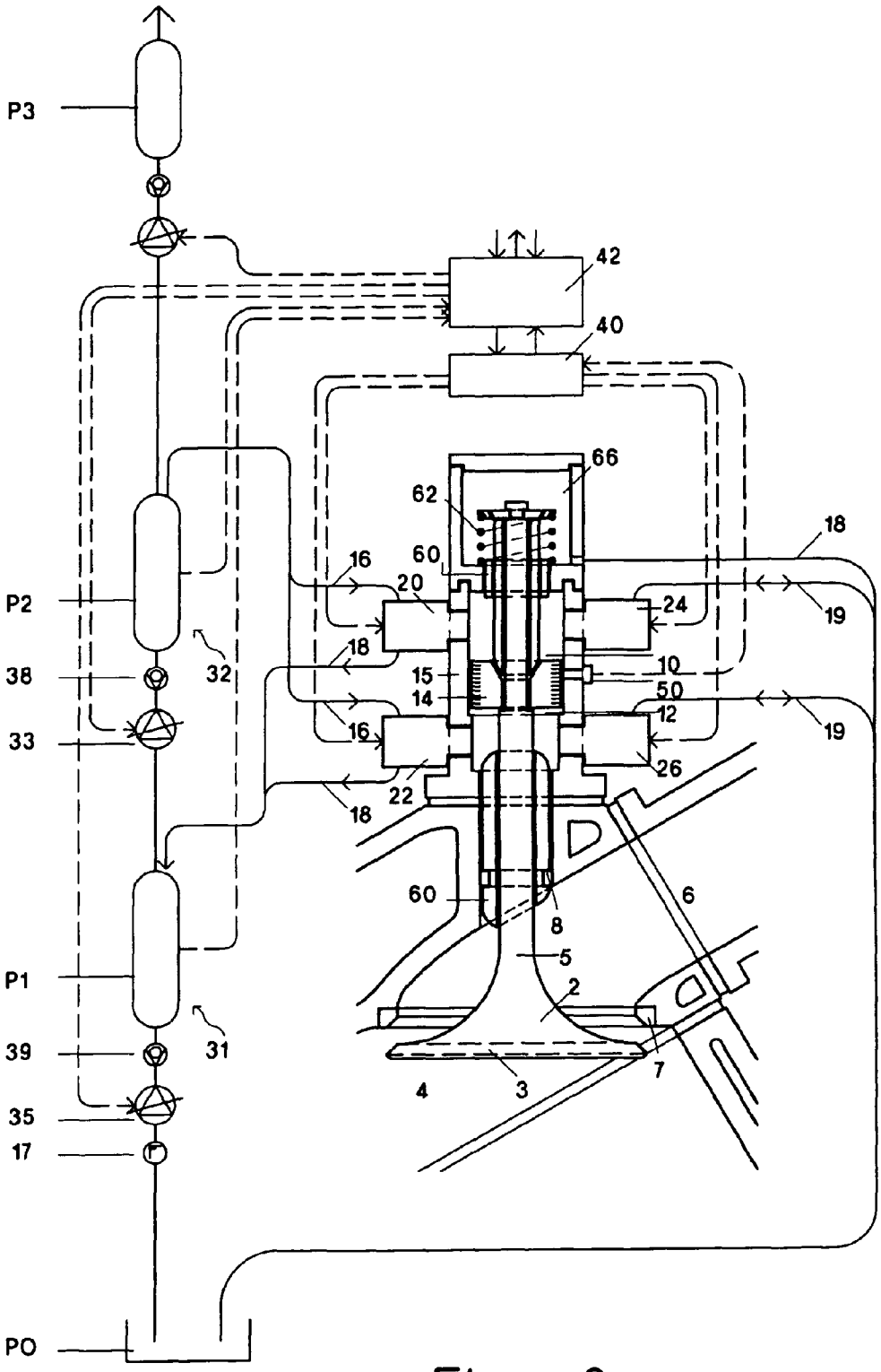
FIG. 2 shows an illustration of an engine valve having a valve control arrangement according to a second exemplary embodiment of the invention.

In a second exemplary embodiment according to FIG. 2, the engine fuel is used as fluid, and the first pressure reservoir P2 serves as an intermediate stage for the provision P3 of the required fuel pressure for the fuel injection. A third pump is provided which provides the required fuel pressure. The operating conditions for the control and the movement of the engine valves 2 are otherwise unchanged.

It will be clear to a person skilled in the art that, within the scope of the patent claims, further modifications are possible without it being necessary to depart from the basic concept of optimum recuperation. These include for example an embodiment (not illustrated here in the figure) in which the first pressure reservoir P2 is fed directly from the base reservoir P0, while the second pressure reservoir P1 is fed either by means of an auxiliary pump or a branch from the first pressure reservoir P2 only during the starting of the engine when no fluid pressure is yet present there, but then obtains its pressure solely from the braking of the engine valves 2. In this case, it may be provided that the excess of energy obtained in the second pressure reservoir P1 as a result of the braking serves—as an intermediate stage—for the above-described provision of the required fuel pressure for the fuel injection.

In the above description, it has been assumed that the pressures in the two pressure reservoirs P1 and P2 will be unequal, with the pressure in P2 being assumed to be greater than that in P1 if P1 is provided as an intermediate stage for P2. This is however not necessary. The pressure in P1 may basically be equal to the pressure in the first pressure reservoir. The two pressure reservoirs P1 and P2 may then be connected or formed together. In this case, the braking force for the engine valves 2 would then be approximately equal to their acceleration force. In one particularly simple, not specially claimed but highly advantageous design of the recuperation, only one pressure reservoir cylinder P2 is provided, which is then preferably connected by means of in each case one fluid line 16 and 18, which is simultaneously designed as a fluid inflow line and also as a fluid outflow line, to the upper first fluid valve 20 and to the lower first fluid valve 20 on the one hand and to the pressure reservoir P2. Said design with self-recuperation is particularly advantageous if the valve control is controlled by means of the length of the overrunning phase. In this case, it would also be possible for the overrunning phase to be configured such that the two first fluid valves 20 and 22 are open, if necessary also when the second fluid valves 24 and 26 are closed.

It would even be possible for the pressure relationships to be interchanged, such that the braking force of the engine valves 2 is greater than their acceleration force, which would then be imparted for longer than the braking force. This may be realized for example by interchanging P2 and P1, with which indeed the two first fluid valves 20 and 22 are acted on.

List of Reference symbols

2 Engine valve
3 Valve plate
4 Combustion chamber
5 Valve shank
6 Combustion gas duct
7 Valve seat ring

8 Seal
10 Upper pressure chamber
12 Lower pressure chamber
14 Actuating piston
15 Pressure chamber housing
16 Fluid inflow line
17 Filter
18 Fluid outflow line
19 Fluid inflow and outflow line
20 Upper first fluid valve, fluid valve means
22 Lower first fluid valve, fluid valve means
24 Upper second fluid valve, fluid valve means
26 Lower second fluid valve, fluid valve means
31 Pressure stage
32 Pressure stage
33 High-pressure pump
35 High-pressure pump
38 Non-return valve
39 Non-return valve
40 Valve control device
42 Central control/regulating device
50 Measuring sensor
60 Valve guide
62 Valve spring
66 Valve spring chamber
P0 Base reservoir for the fluid
P1 Second pressure reservoir for the fluid
P2 First pressure reservoir for the fluid
P3 Additional pressure reservoir for fuel injection

The invention claimed is:

1. A fluid-operated valve drive for a gas exchange valve in a combustion cylinder of an internal combustion engine, having at least two fluid-filled pressure chambers, having an actuating piston which acts on said valve and which can be moved from a valve closed position into a valve open position and from the valve open position into the valve closed position, said actuating piston has two active surfaces which delimit in each case one of said pressure chambers, with the pressure chambers being connected to in each case two fluid valve means, specifically first and second fluid valve means, in each case said first fluid valve means being connectable to a first pressure reservoir, in each case said second fluid valve means being connectable to a base pressure reservoir, also having a control device for opening and closing said fluid valve means, said first fluid valve means being connectable to a second pressure reservoir in such a way that said first fluid valve means can assume a position in which they are closed, connected to said first reservoir or connected to said second reservoir, said second fluid valve means being capable or occupying a position in which they are closed or connected to said base reservoir, wherein said control device is set up such that the gas exchange valve, in addition to the open and the closed positions, can be switched at least into a first, accelerated movement phase which is effected by virtue of one of the first fluid valve means being acted on with the pressure of said first reservoir and by virtue of one of said second fluid valve means being opened to said base reservoir, and into a braking phase which is effected by virtue of the other of said first fluid valve means being opened to said second pressure reservoir and the first-opened of said second fluid valve means being closed and the other of said second fluid valve means being opened to said base reservoir, and wherein said second pressure reservoir is provided as an intermediate pressure stage for one of more of: the provision of the pressure in said first pressure reservoir; the provision of pressure for a fuel pump; the fuel conditioning of an internal combustion engine; and the pressure conditioning for a further gas exchange valve in the same combustion cylinder or in a different combustion cylinder of the internal combustion engine;

wherein the control device is set up such that said valve can also be switched into a substantially nonaccelerated phase which is effected by virtue of said two second fluid valve means being opened to said base reservoir, with said first fluid valve means being closed, characterized in that:

in an internal combustion engine having at least one said valve drive for at least one gas exchange valve in at least one combustion cylinder of the internal combustion engine and having a further valve drive for a further gas exchange valve in the same combustion cylinder and/or in a different combustion cylinder internal combustion engine, characterized in that said second pressure reservoir is provided for the pressure conditioning for said valve drive of the further gas exchange valve in the same combustion cylinder and/or in a different combustion cylinder of the internal combustion engine.

2. A fluid-operated valve drive for a gas exchange valve in a combustion cylinder of an internal combustion engine, having at least two fluid-filled pressure chambers, having an actuating piston which acts on said valve and which can be moved from a valve closed position into a valve open position and from the valve open position into the valve closed position, said actuating piston has two active surfaces which delimit in each case one of said pressure chambers, with the pressure chambers being connected to in each case two fluid valve means, specifically first and second fluid valve means, in each case said first fluid valve means being connectable to a first pressure reservoir, in each case said second fluid valve means being connectable to a base pressure reservoir, also having a control device for opening and closing said fluid valve means, said first fluid valve means being connectable to a second pressure reservoir in such a way that said first fluid valve means can assume a position in which they are closed, connected to said first reservoir or connected to said second reservoir, said second fluid valve means being capable or occupying a position in which they are closed or connected to said base reservoir, wherein said control device is set up such that the gas exchange valve, in addition to the open and the closed positions, can be switched at least into a first, accelerated movement phase which is effected by virtue of one of the first fluid valve means being acted on with the pressure of said first reservoir and by virtue of one of said second fluid valve means being opened to said base reservoir, and into a braking phase which is effected by virtue of the other of said first fluid valve means being opened to said second pressure reservoir and the first-opened of said second fluid valve means being closed and the other of said second fluid valve means being opened to said base reservoir, and wherein said second pressure reservoir is provided as an intermediate pressure stage for one or more of: the provision of the pressure in said first pressure reservoir; the provision of pressure for a fuel pump; the fuel conditioning of an internal combustion engine; and the pressure conditioning for a further gas exchange valve in the same combustion cylinder or in a different combustion cylinder of the internal combustion engine; and, wherein a third pressure reservoir is provided which serves for the supply or conditioning of fuel and is supplied from said first or from said second pressure reservoir as an intermediate pressure stage.

3. The valve drive as claimed in claim 2, wherein said fuel used in the internal combustion engine is provided as fluid.

4. The valve drive as claimed in claim 1, wherein said second fluid valve means can be controlled with regard to their degree of opening.

5. The valve drive as claimed in claim 1, wherein the control device is designed such that, during the transition phase from said first to said substantially non-accelerated phase and/or from said substantially non-accelerated to said second phase, said two second fluid valve means can be connected for a certain period of time to said base pressure reservoir while one of said first fluid valve means is open.

6. The valve drive as claimed in claim 1, further comprising measuring means for measuring the position of the gas exchange valve, preferably for measuring the position of the actuating piston.

7. The valve drive as claimed in claim 6, wherein the movement of the gas exchange valve is regulated using the measured values of said measuring means, with the regulation being carried out at least by means of the length of the acceleration phase, the length of the non accelerated phase, with the time in which both second fluid valve means are simultaneously open, and/or the degree of opening of said second fluid valve means.

8. The valve drive as claimed in claim 4, further comprising a two-stage pressure generation for said first pressure reservoir from said second pressure reservoir.

9. The valve drive as claimed in claim 4, wherein the pressure in said first pressure reservoir is greater than that in said second pressure reservoir.

10. The valve drive as claimed in claim 4, wherein the pressure in said first pressure reservoir is approximately equal to that in said second pressure reservoir.

11. The valve drive as claimed in claim 4, wherein the pressure in said second pressure reservoir is greater than that in said first pressure reservoir.

12. An internal combustion engine having at least one fluid-operated valve drive for at least one gas exchange valve in at least one combustion cylinder of the internal combustion engine, said fluid-operated valve drive having:

at least two fluid-filled pressure chambers, having an actuating piston which acts on said valve and which can be moved from a valve closed position into a valve open position and from the valve open position into the valve closed position, said actuating piston has two active surfaces which delimit in each case one of said pressure chambers, with the pressure chambers being connected to in each case two fluid valve means, specifically first and second fluid valve means, in each case said first fluid valve means being connectable to a first pressure reservoir, in each case said second fluid valve means being connectable to a base pressure reservoir, also having a control device for opening and closing said fluid valve means, said first fluid valve means being connectable to a second pressure reservoir in such a way that said first fluid valve means can assume a position in which they are closed, connected to said first reservoir or connected to said second reservoir, said second fluid valve means being capable or occupying a position in which they are closed or connected to said base reservoir, wherein said control device is set up such that the gas exchange valve, in addition to the open and the closed positions, can be switched at least into a first, accelerated movement phase which is effected by virtue of one of the first fluid valve means being acted on with the pressure of said first reservoir and by virtue of one of said second fluid valve means being opened to said base reservoir, and into a braking phase which is effected by virtue of the other of said first fluid valve means being opened to said second pressure reservoir and the first-opened of said second fluid valve means being closed and the other of said second fluid valve means being opened to said base reservoir, and wherein said second pressure reservoir is provided as an intermediate pressure stage for one or more of: the provision of the pressure in said first pressure reservoir; the provision of pressure for a fuel pump; the fuel conditioning of an internal combustion engine; and the pressure conditioning for a further gas exchange valve in the same combustion cylinder or in a different combustion cylinder of the internal combustion engine, and, having a further valve drive for a further gas exchange valve in the same combustion cylinder and/or in a different combustion cylinder internal combustion engine, characterized in that said second pressure reservoir is provided for the pressure conditioning for said valve drive of the further gas exchange valve in the same combustion cylinder and/or in a different combustion cylinder of the internal combustion engine.

13. The internal combustion engine as claimed in claim 12, wherein said at least one gas exchange valve is designed as an outlet valve while said further gas exchange valve, for the pressure conditioning of which said second pressure reservoir is provided, is designed as an inlet valve.

14. A fluid-operated valve drive for a gas exchange valve in a combustion cylinder of an internal combustion engine, having at least two fluid-filled pressure chambers, having an actuating piston which acts on said valve and which can be moved from a valve closed position into a valve open position and from the valve open position into the valve closed position, said actuating piston has two active surfaces which delimit in each case one of said pressure chambers, with the pressure chambers being connected to in each case two fluid valve means, specifically first and second fluid valve means, in each case said first fluid valve means being connectable to a first pressure reservoir, in each case said second fluid valve means being connectable to a base pressure reservoir, also having a control device for opening and closing said fluid valve means, said first fluid valve means being connectable to a second pressure reservoir in such a way that said first fluid valve means can assume a position in which they are closed, connected to said first reservoir or connected to said second reservoir, said second fluid valve means being capable or occupying a position in which they are closed or connected to said base reservoir, wherein said control device is set up such that the gas exchange valve, in addition to the open and the closed positions, can be switched at least into a first, accelerated movement phase which is effected by virtue of one of the first fluid valve means being acted on with the pressure of said first reservoir and by virtue of one of said second fluid valve means being opened to said base reservoir, and into a braking phase which is effected by virtue of the other of said first fluid valve means being opened to said second pressure reservoir and the first-opened of said second fluid valve means being closed and the other of said second fluid valve means being opened to said base reservoir, and wherein said second pressure reservoir is provided as an intermediate pressure stage for one of more of: the provision of the pressure in said first pressure reservoir; the provision of pressure for a fuel pump; the fuel conditioning of an internal combustion engine; and the pressure conditioning for a further gas exchange valve in the same combustion cylinder or in a different combustion cylinder of the internal combustion engine;

wherein said second fluid valve means can be controlled with regard to their degree of opening, characterized in that:

in an internal combustion engine having at least one said valve drive for at least one gas exchange valve in at least one combustion cylinder of the internal combustion engine and having a further valve drive for a further gas exchange valve in the same combustion cylinder and/or in a different combustion cylinder internal combustion engine, characterized in that said second pressure reservoir is provided for the pressure conditioning for said valve drive of the further gas exchange valve in the same combustion cylinder and/or in a different combustion cylinder of the internal combustion engine.

15. A fluid-operated valve drive for a gas exchange valve in a combustion cylinder of an internal combustion engine, having at least two fluid-filled pressure chambers, having an actuating piston which acts on said valve and which can be moved from a valve closed position into a valve open position and from the valve open position into the valve closed position, said actuating piston has two active surfaces which delimit in each case one of said pressure chambers, with the pressure chambers being connected to in each case two fluid valve means, specifically first and second fluid valve means, in each case said first fluid valve means being connectable to a first pressure reservoir, in each case said second fluid valve means being connectable to a base pressure reservoir, also having a control device for opening and closing said fluid valve means, said first fluid valve means being connectable to a second pressure reservoir in such a way that said first fluid valve means can assume a position in which they are closed, connected to said first reservoir or connected to said second reservoir, said second fluid valve means being capable or occupying a position in which they are closed or connected to said base reservoir, wherein said control device is set up such that the gas exchange valve, in addition to the open and the closed positions, can be switched at least into a first, accelerated movement phase which is effected by virtue of one of the first fluid valve means being acted on with the pressure of said first reservoir and by virtue of one of said second fluid valve means being opened to said base reservoir, and into a braking phase which is effected by virtue of the other of said first fluid valve means being opened to said second pressure reservoir and the first-opened of said second fluid valve means being closed and the other of said second fluid valve means being opened to said base reservoir, and wherein said second pressure reservoir is provided as an intermediate pressure stage for one or more of: the provision of the pressure in said first pressure reservoir; the provision of pressure for a fuel pump; the fuel conditioning of an internal combustion engine; and the pressure conditioning for a further gas exchange valve in the same combustion cylinder or in a different combustion cylinder of the internal combustion engine;

wherein the control device is set up such that said valve can also be switched into a substantially nonaccelerated phase which is effected by virtue of said two second fluid valve means being opened to said base reservoir, with said first fluid valve means being closed;

wherein the control device is designed such that, during the transition phase from said first to said substantially nonaccelerated phase and/or from said substantially nonaccelerated to said second phase, said two second fluid valve means can be connected for a certain period of time to said base pressure reservoir while one of said first fluid valve means is open, characterized in that:

in an internal combustion engine having at least one said valve drive for at least one gas exchange valve in at least one combustion cylinder of the internal combustion engine , and having a further valve drive for a further gas exchange valve in the same combustion cylinder and/or in a different combustion cylinder internal combustion engine, characterized in that said second pressure reservoir is provided for the pressure conditioning for said valve drive of the further gas exchange valve in the same combustion cylinder and/or in a different combustion cylinder of the internal combustion engine.

16. A fluid-operated valve drive for a gas exchange valve in a combustion cylinder of an internal combustion engine, having at least two fluid-filled pressure chambers, having an actuating piston which acts on said valve and which can be moved from a valve closed position into a valve open position and from the valve open position into the valve closed position, said actuating piston has two active surfaces which delimit in each case one of said pressure chambers, with the pressure chambers being connected to in each case two fluid valve means, specifically first and second fluid valve means, in each case said first fluid valve means being connectable to a first pressure reservoir, in each case said second fluid valve means being connectable to a base pressure reservoir, also having a control device for opening and closing said fluid valve means, said first fluid valve means being connectable to a second pressure reservoir in such a way that said first fluid valve means can assume a position in which they are closed, connected to said first reservoir or connected to said second reservoir, said second fluid valve means being capable or occupying a position in which they are closed or connected to said base reservoir, wherein said control device is set up such that the gas exchange valve, in addition to the open and the closed positions, can be switched at least into a first, accelerated movement phase which is effected by virtue of one of the first fluid valve means being acted on with the pressure of said first reservoir and by virtue of one of said second fluid valve means being opened to said base reservoir, and into a braking phase which is effected by virtue of the other of said first fluid valve means being opened to said second pressure reservoir and the first-opened of said second fluid valve means being closed and the other of said second fluid valve means being opened to said base reservoir, and wherein said second pressure reservoir is provided as an intermediate pressure stage for one or more of: the provision of the pressure in said first pressure reservoir, the provision of pressure for a fuel pump; the fuel conditioning of an internal combustion engine; and the pressure conditioning for a further gas exchange valve in the same combustion cylinder or in a different combustion cylinder of the internal combustion engine;

further comprising measuring means for measuring the position of the gas exchange valve, preferably for measuring the position of the actuating piston, characterized in that:

in an internal combustion engine having at least one said valve drive for at least one gas exchange valve in at least one combustion cylinder of the internal combustion engine and having a further valve drive for a further gas exchange valve in the same combustion cylinder and/or in a different combustion cylinder internal combustion engine, characterized in that said second pressure reservoir is provided for the pressure conditioning for said valve drive of the further gas exchange valve in the same combustion cylinder and/or in a different combustion cylinder of the internal combustion engine.

17. The valve drive as claimed in claim 14, further comprising a two-stage pressure generation for said first pressure reservoir from said second pressure reservoir.

18. The valve drive as claimed in claim 14, wherein the pressure in said first pressure reservoir is greater than that in said second pressure reservoir.

19. The valve drive as claimed in claim 14, wherein the pressure in said first pressure reservoir is approximately equal to that in said second pressure reservoir.

20. The valve drive as claimed in claim 14, wherein the pressure in said second pressure reservoir is greater than that in said first pressure reservoir.

21. The valve drive as claimed in claim 15, further comprising a two-stage pressure generation for said first pressure reservoir from said second pressure reservoir.

22. The valve drive as claimed in claim 15, wherein the pressure in said first pressure reservoir is greater than that in said second pressure reservoir.

23. The valve drive as claimed in claim 15, wherein the pressure in said first pressure reservoir is approximately equal to that in said second pressure reservoir.

24. The valve drive as claimed in claim 15, wherein the pressure in said second pressure reservoir is greater than that in said first pressure reservoir.

25. The valve drive as claimed in claim 16, further comprising a two-stage pressure generation for said first pressure reservoir from said second pressure reservoir.

26. The valve drive as claimed in claim 16, wherein the pressure in said first pressure reservoir is greater than that in said second pressure reservoir.

27. The valve drive as claimed in claim 16, wherein the pressure in said first pressure reservoir is approximately equal to that in said second pressure reservoir.

28. The valve drive as claimed in claim 16, wherein, the pressure in said second pressure reservoir is greater than that in said first pressure reservoir.

* * * * *